US008641433B2

(12) United States Patent
Uchida

(10) Patent No.: US 8,641,433 B2
(45) Date of Patent: Feb. 4, 2014

(54) LEVER-TYPE CONNECTOR WITH LOCKING MEMBER

(75) Inventor: Tomohisa Uchida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 33 days.

(21) Appl. No.: 13/458,061

(22) Filed: Apr. 27, 2012

(65) Prior Publication Data

US 2012/0289070 A1 Nov. 15, 2012

(30) Foreign Application Priority Data

May 12, 2011 (JP) ..... 2011-107122

(51) Int. Cl.
*H01R 13/62* (2006.01)

(52) U.S. Cl.
USPC ..... 439/157; 439/372

(58) Field of Classification Search
USPC ..... 439/157, 372
See application file for complete search history.

(56) References Cited

U.S. PATENT DOCUMENTS 5,823,809 A * 10/1998 Wakata ..... 439/157
5,928,010 A * 7/1999 Katsuma et al. ..... 439/157
6,319,050 B1 11/2001 Miyazaki et al.
7,052,294 B1 * 5/2006 Osada ..... 439/157
7,137,835 B2 * 11/2006 Shiga ..... 439/157
7,396,240 B2 * 7/2008 Frederiksen et al. ..... 439/157
7,559,780 B2 * 7/2009 Mizoguchi et al. ..... 439/157
8,403,693 B2 * 3/2013 Uchida ..... 439/271
2002/0031928 A1 * 3/2002 Gundermann et al. ..... 439/157
2007/0238336 A1 10/2007 Frederiksen et al.
2009/0023317 A1 1/2009 Mizoguchi et al.
2011/0287648 A1 * 11/2011 Uchida ..... 439/271

FOREIGN PATENT DOCUMENTS

JP 2003-178837 6/2003
WO 2007146130 A2 12/2007

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

A lever (60) is formed with a resiliently deformable lock arm (71) projecting substantially along a rotating direction of the lever (60). A housing (20) is formed with a base piece (27) standing in a direction crossing a connecting direction to a mating connector (90). An engaging portion (35) for holding the housing (20) and the mating connector (90) in the properly connected state by being resiliently engaged with a leading end part of the lock arm (71) is formed on a leading end part of the base piece (27). A recess (33) into which a finger (50) is insertable to disengage the engaging portion (35) and the lock arm (71) is formed in a base end part of the base piece (27).

10 Claims, 8 Drawing Sheets

LEVER-TYPE CONNECTOR WITH LOCKING MEMBER

BACKGROUND OF THE INVENTION

1. Field of the Invention

The invention relates to a lever-type connector.

2. Description of the Related Art

Japanese Publication No. 2003-178837 discloses a connector with a housing and a lever to be mounted rotatably on the housing. The housing is connectable to a mating connector as the lever is rotated. The lever has an operating portion and a resiliently deformable lock arm projects from the operating portion substantially along a rotating direction of the lever. A base piece projects back from the rear end of the upper surface of the mating connector and an engaging portion projects up on a rear end part of the base piece.

The lever is engaged with the mating connector and is rotated forward from the back side. The lever exhibits a force multiplying action that enables the housing to be connected to the mating connector with a small operation force. A leading end part of the lock arm resiliently engages the engaging portion of the base piece when the operating portion of the lever reaches a position behind the mating connector. As a result, the lever is held on the mating connector and the mating connector and the housing are held in a connected state.

An engagement margin of the lock arm of the above-identified conventional lever-type connector with the engaging portion of the mating connector varies due to backlash between the lever-type connector and the mating connector. Further, the base piece and the lock arm project back from the rear end of the mating connector. Thus, a large space is required in a forward and backward connecting direction.

The above-described problems can be solved if the base piece and the engaging portion are formed on the housing. However, the leading end of the lock arm and the engaging portion then would be between the mating connector and the housing when the connectors are connected. Thus, a finger cannot easily be placed on the leading end of the lock arm or the engaging portion and a locking state is not released easily.

The invention was completed in view of the above situation and an object thereof is to improve operability in releasing a locking state of a lock arm.

SUMMARY OF THE INVENTION

The invention relates to a lever-type connector with a housing that is connectable to a mating connector. A lever is mounted rotatably or pivotably on the housing. A resiliently deformable lock arm is formed on the lever and projects substantially along a rotating direction of the lever. A base piece is formed on the housing and stands in a direction crossing a connecting direction to the mating connector. Thus, the base piece and the lock arm do not project in the connecting direction and space efficiency is excellent. An engaging portion is formed on a leading end part of the base piece and resiliently engages a leading end part of the lock arm for holding the housing and the mating connector in the properly connected state. A recess is formed in a base end part of the base piece and can receive a finger to disengage the engaging portion and the lock arm. Therefore, the locking state of the lock arm can be released easily.

The lever can be rotated while engaged with the mating connector and a force multiplying action of the lever brings the housing and the mating connector to a properly connected state.

The mating connector may be coupled to an external member, such as a device or a substrate, and an insertion space for a finger may be between the external member and the base piece when the housing is connected to the mating connector. Therefore, it is difficult to insert the finger into the insertion space. However, the recess of the present invention ensures the insertion space for the finger.

The lock arm is arranged along an oblique direction crossing the connecting direction and a direction perpendicular to the connecting direction when the housing is connected to the mating connector. Thus, the entire length of the lock arm can be made longer with high space efficiency. As a result, an engagement margin of the lock arm with the engaging portion also can be made larger.

The base piece preferably is bent along the recess. As a result, the formation range of the recess is not limited to the thickness range of the base end part of the base piece and a degree of freedom in forming the recess can be increased. Further, the rigidity of the base piece is assured.

The base piece preferably includes a bent portion in an intermediate part projecting in a projecting direction. A leading part outside of the bent portion is at an angle different from 0° or 180° to a base part.

The base piece preferably includes a first piece located at the base side and projecting in the projecting direction from the housing and a second piece located at the leading end side and projecting in a direction substantially straight in an obliquely outward direction toward the front from the bend.

The entire base piece preferably is behind the front end of the housing and a leading end of the second piece preferably is slightly behind the front end of the housing.

The projecting direction of the second piece and the projecting direction of the engaging portion preferably are substantially perpendicular to each other.

A lock portion of the lever preferably is arranged substantially along the connecting direction and an arm body of the lever preferably is arranged along the oblique direction crossing the connecting direction and the direction perpendicular to the connecting direction so that the arm body and the engaging portion are substantially parallel when the lever is at the connection position.

These and other objects, features and advantages of the invention will become more apparent upon reading the following detailed description of the preferred embodiment and accompanying drawings.

DETAILED DESCRIPTION OF THE PREFERRED EMBODIMENTS

Figure 1:
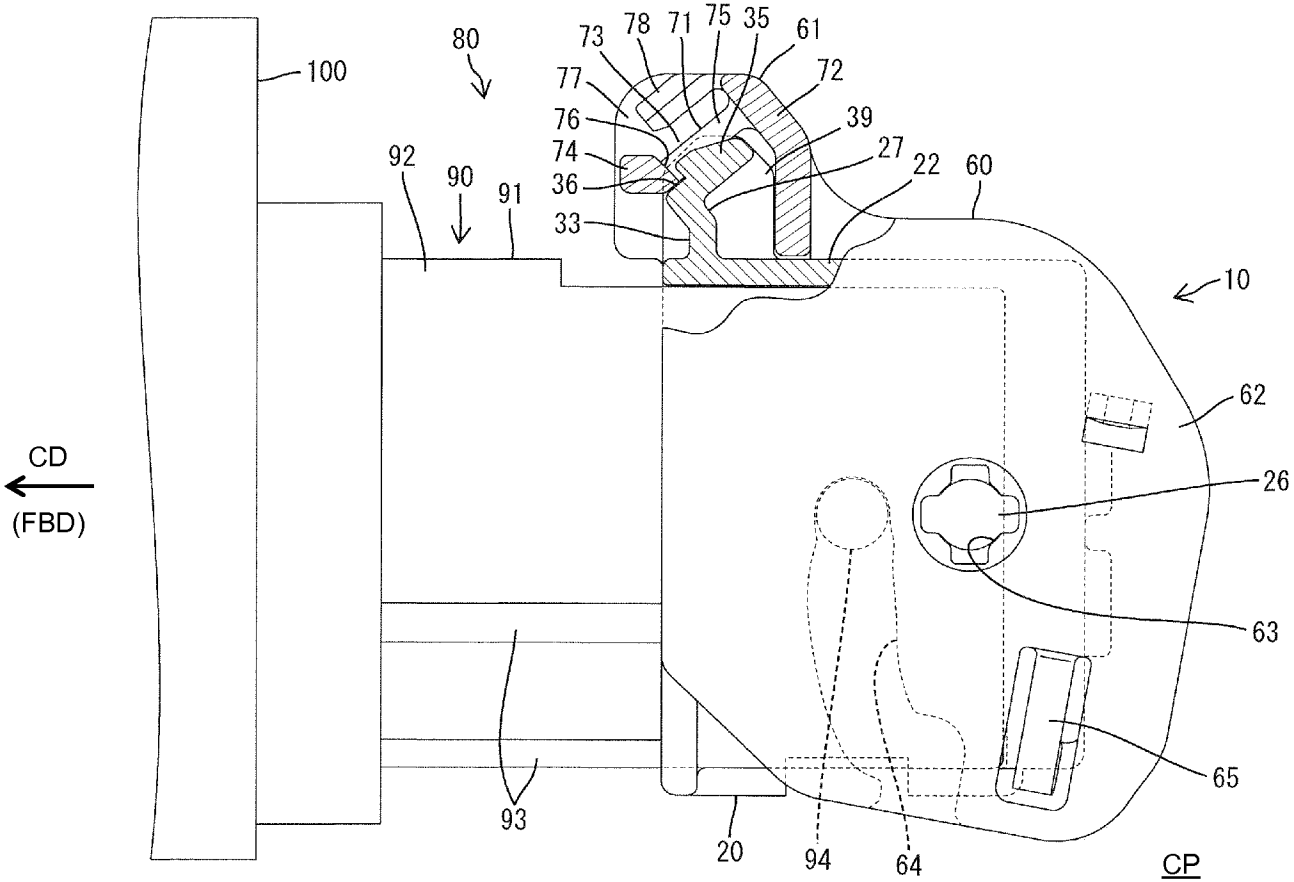
FIG. 1 is a side view showing an essential part in section in a state where a housing is connected properly to a mating connector according to the invention.

A lever-type connector according to the invention is identified by the number 10 in FIGS. 1 to 8. The connector 10 includes a housing 20 and a lever 60. The housing 20 is connectable to a mating connector 90 in a connecting direction CD. In the following description, an end to be connected to the mating connector 90 is referred to as the front concerning forward and backward directions FBD.

Figure 2:
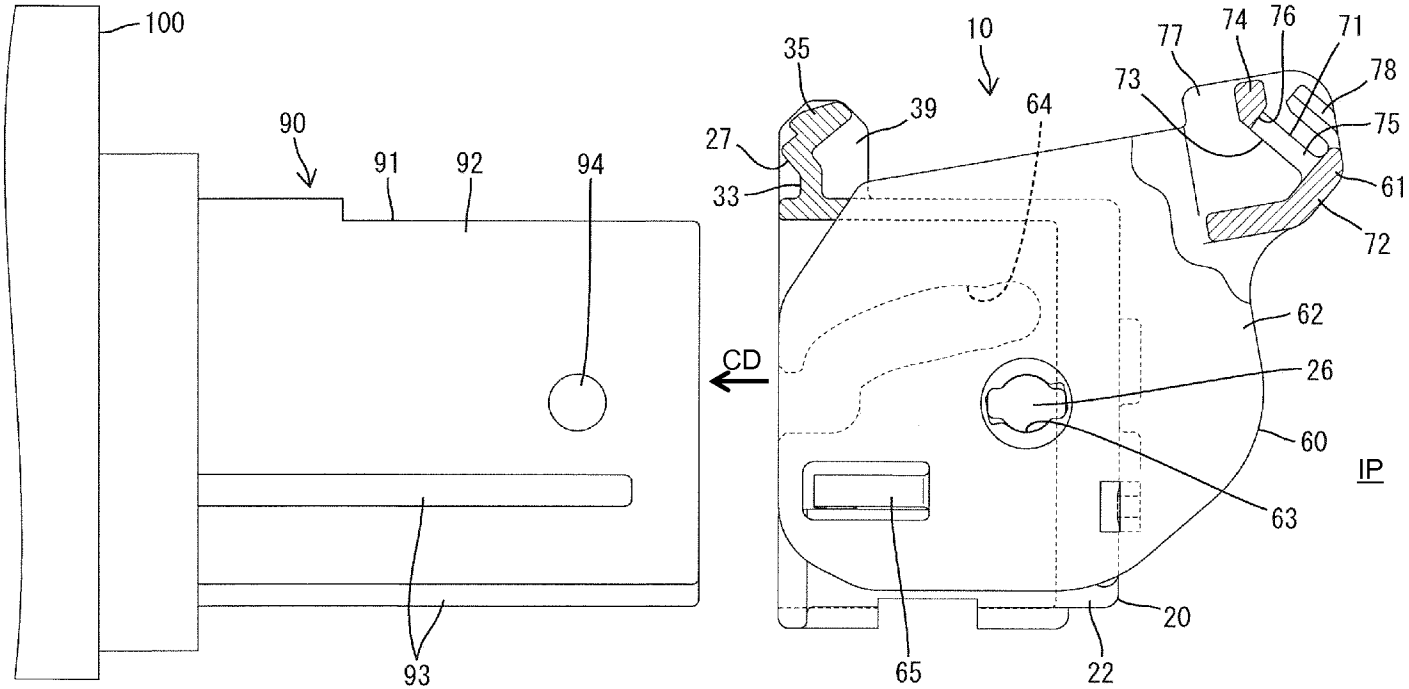
FIG. 2 is a side view showing an essential part in section in a state before the housing is connected to the mating connector.

As shown in FIG. 2, the mating connector 90 is mounted directly on an external member 100 such as an auxiliary machine and includes a mating housing 91 made e.g. of synthetic resin. The mating housing 91 has a substantially rectangular tubular receptacle 92 that opens forward and unillustrated male tabs project into the receptacle 92. Long narrow ribs 93 are formed on an outer side surface and lower surface of the receptacle 92 and extend in forward and backward directions FBD. Substantially cylindrical cam followers 94 project from the outer side surfaces of the receptacle 92.

Figure 6:
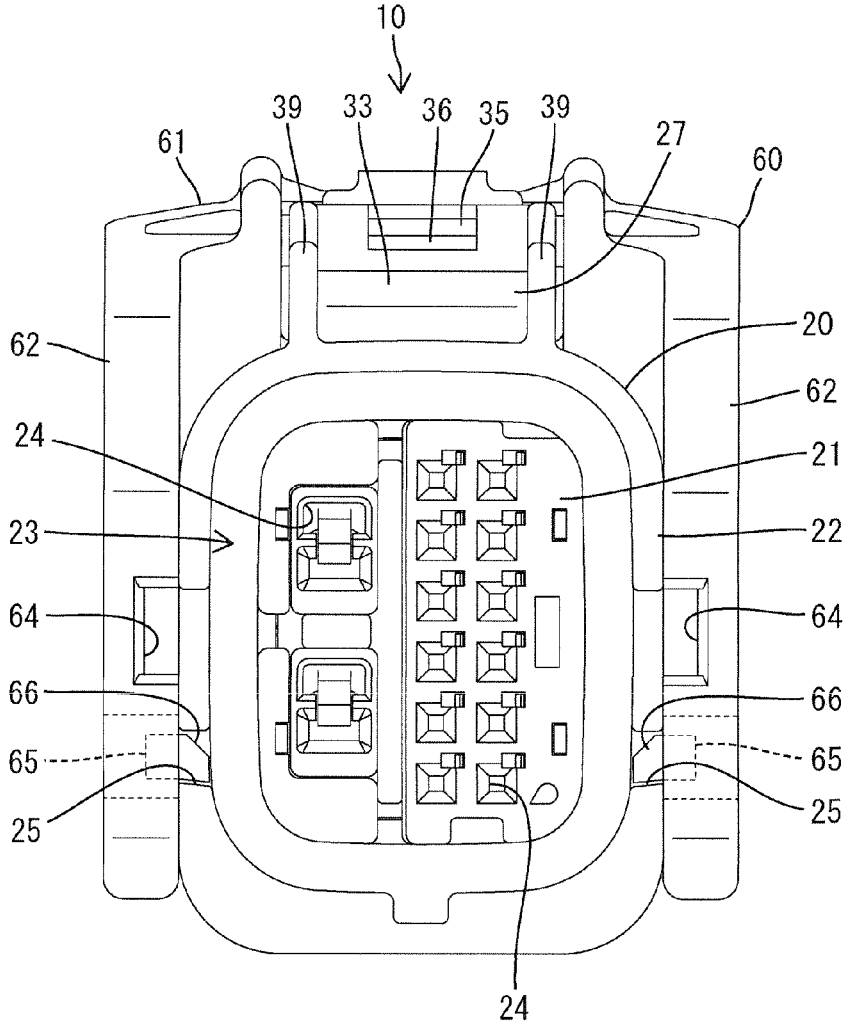
FIG. 6 is a front view showing a lever mounted on the housing at an initial position.
Figure 7:
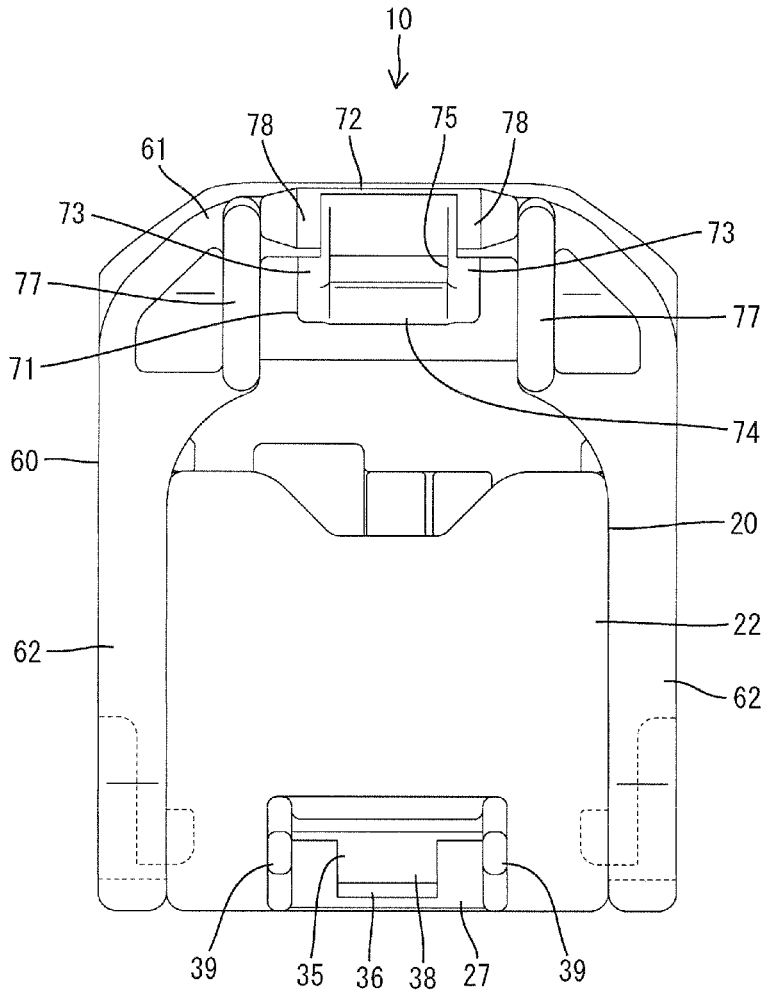
FIG. 7 is a plan view showing the lever mounted on the housing at the initial position.

The housing 20 is made e.g. of synthetic resin and, as shown in FIGS. 6 and 7, includes a substantially block-shaped main body 21 and a substantially rectangular fitting tube 22 surrounds the main body 21. A forwardly open insertion space 23 is formed between the main body 21 and the fitting tube 22 and can receive the receptacle 92. Cavities 24 extend through the housing main body 21 in forward and backward directions FBD and unillustrated female terminal fittings are insertable into the respective cavities 24 and have larger and smaller sizes according to the sizes of the respective terminal fittings.

Figure 5:
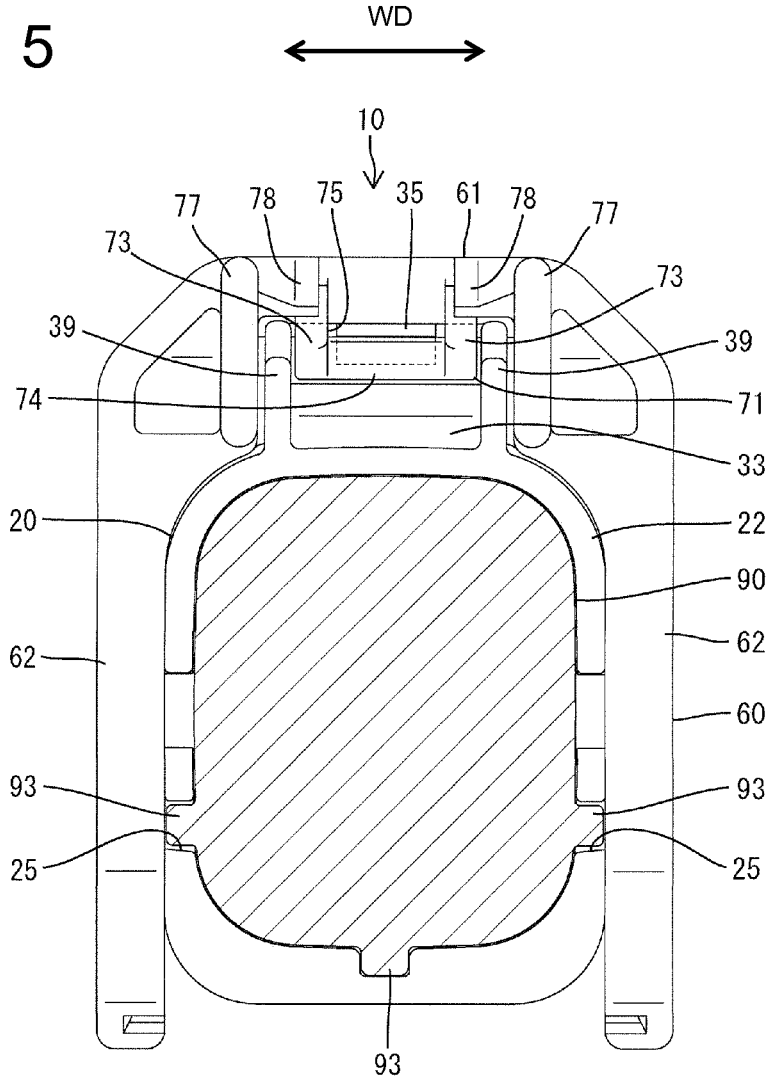
FIG. 5 is a section showing a state where the housing is connected properly to the mating connector.

Two long narrow forwardly open slits 25 are formed in the side walls of the fitting tube 22 and extend in forward and backward directions FBD. As shown in FIG. 5, the ribs 93 are inserted into the slits 25 from the front, thereby guiding a connecting operation to the mating connector 90 and preventing erroneous connection to the mating connector 90. Two substantially cylindrical supporting shafts 26 project on rear end parts of the outer side surfaces of the fitting tube 22 at substantially the same height as the cam followers 94, as shown in FIG. 2.

Figure 8:
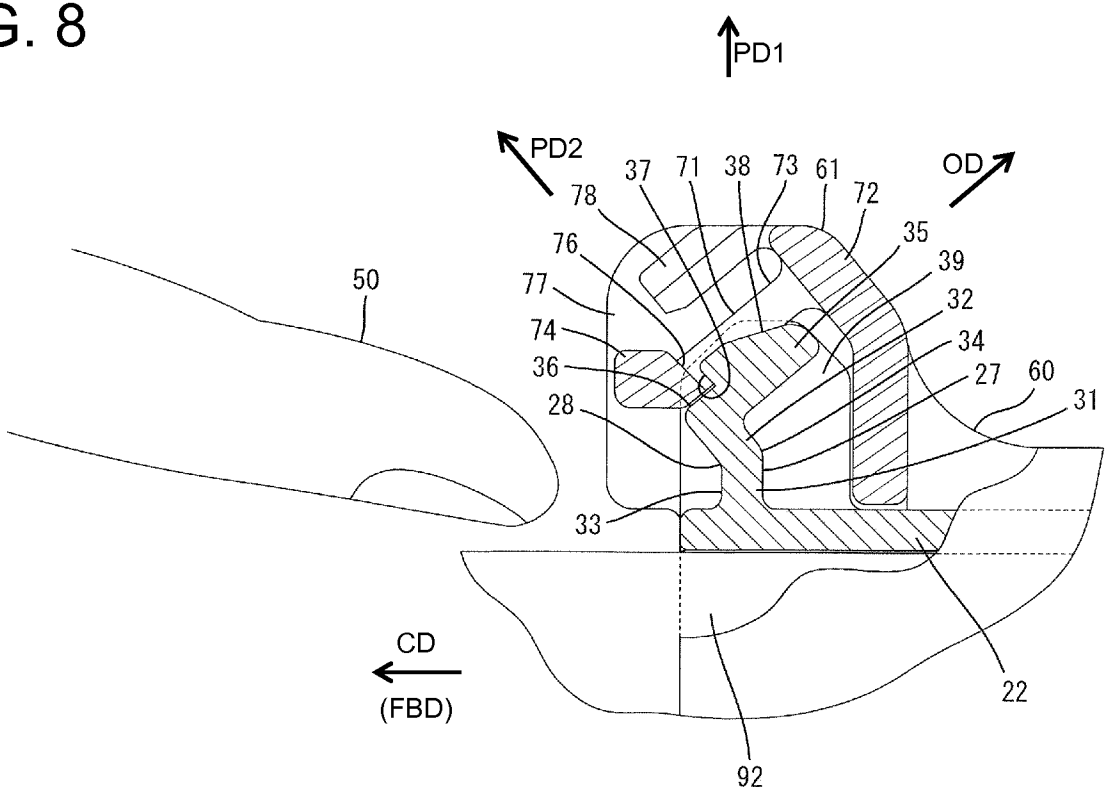
FIG. 8 is an enlarged side view showing an essential part in section in a state immediately before a finger is placed in a recess to release a locking state of the lock arm.

As shown in FIG. 2, a base piece 27 is formed on a front end part of the upper outer surface of the fitting tube 22 projects up in a direction PD1 that is substantially perpendicular to the connecting direction CD. A bend 28 is formed in a substantially central part the base piece 27 in the projecting direction PD1, as shown in FIG. 8 and a leading end above the bend 28 is at an angle to a base end. Specifically, the base piece 27 includes first and second pieces 31 and 32 on opposite sides of the bend 28. The first piece 31 projects substantially straight up in the projecting direction PD1 substantially perpendicular to the upper surface of the fitting tube 22. The second piece 32 is substantially straight and projects obliquely up from the bend 28 in a direction PD2. The entire base piece 27 is behind the front end of the housing 20.

A recess 33 is formed by depressing the front surface of a base end part of the base piece 27 over the entire width of the base piece 27 and a finger 50 can be inserted into the recess 33 from the front, as shown in FIG. 8. On the other hand, a projection 34 projects back from the rear surface of the base end part of the base piece 27 at a position substantially opposite the recess 33. The recess 33 is defined by the front surfaces of the first and second pieces 31, 32 and the projection 34 is defined by the rear surfaces of the first and second pieces 31, 32.

An engaging portion 35 projects from a substantially widthwise central part of a leading end of the second piece 32 and extends obliquely up and back in an oblique direction OD that crosses both the connecting direction CD and the direction perpendicular to the connecting direction CD. A projecting direction PD2 of the second piece 32 and the projecting direction OD of the engaging portion 35 are substantially perpendicular. A locking step 36 in the form of a substantially rectangular recess is formed in a substantially widthwise central part of the front end of the upper surface of the engaging portion 35. An engaging surface 37 is formed at the rear of the locking step 36 and extends substantially parallel to the projecting direction PD2 of the second piece 32. Further, a rear part of the engaging portion 35 is thinned gradually toward the leading rear end and a guiding surface 38 is formed on the upper side of the engaging portion 35. The guiding surface 38 is inclined obliquely out and up.

As shown in FIGS. 6 and 7, two protecting walls 39 stand at opposite widthwise sides of the base piece 27, on the front end part of the upper outer surface of the fitting tube 22. The protecting walls 39 protect base piece 27 from external matter.

The lever 60 is a substantially U-shaped member made e.g. of synthetic resin, as shown in FIG. 7. Specifically, the lever 60 has an operating portion 61 that extends along the width direction WD and two parallel arms 62 project from the opposite ends of the operating portion 61. A substantially circular bearing 63 penetrates each arm 62, as shown in FIG. 2. A cam groove 64 is formed in the inner surface of each arm 62 and is open at the outer peripheral edge. The lever 60 is mounted to cross over the housing 20 from above and the supporting shafts 26 are fit in the bearings 63. Thus, the lever 60 is rotatable about the supporting shafts 26 between an initial position IP and a connection position CP. The cam followers 94 are inserted into the cam grooves 64 with the lever 60 at the initial position IP. The lever 60 then is rotated toward the connection position CP. As a result, the cam followers 94 slide along inner surfaces of the cam grooves 64. A force multiplying action is created between the lever 60 and the mating connector 90 so that the mating connector 90 is pulled toward the housing 20 with a small operating force. The cam followers 94 reach the back ends of the cam grooves 64 at the connection position CP and the housing 20 is connected properly to the mating connector 90.

Each arm 62 is cut to form a resiliently deformable resilient locking piece 65. As shown in FIG. 6, tip projections 66 of the resilient locking pieces 65 engage the inner edges of the slits 25 to hold the lever 60 at the initial position IP. Further, the ribs 93 enter the slits 25 at an initial stage of the connecting operation and disengage the tip projections 66 of the resilient locking pieces 65 from the inner edges of the slits 25, thereby permitting the lever 60 to rotate in a rotating direction RD toward the connection position CP.

As shown in FIGS. 2 and 7, the lock arm 71 is formed in a substantially widthwise central part of the operating portion 61 and is resiliently engageable with the engaging portion 35. A back plate 72 is formed on a rear end of the operating portion 61, and the lock arm 71 cantilevers forward from the front surface of this back plate 72. The lock arm 71 is resiliently deformable out and in or up and down relative to the end that is connected to the back plate 72. In the case of this embodiment, the lock arm 71 is aligned obliquely out or up toward the front at the initial position IP (see FIG. 2), but is aligned obliquely down toward the front at the connection position CP (see FIG. 1). In other words, the lock arm 71 is arranged substantially along the rotating direction RD of the lever 60 from the initial position IP to the connection position CP.

As shown in FIGS. 5 and 7, the lock arm 71 is substantially U-shaped and includes two arms 73 extending substantially perpendicularly from the back plate 72 and substantially facing in the width direction WD, and the lock 74 connecting the leading ends of the arms 73 and extending in the width direction WD. A lock hole 75 is formed by the arms 73 and the lock 74. A locking surface 76 is formed on the rear of the lock 74 and can come into contact with the engaging surface 37 of the engaging portion 35, as shown in FIG. 8. The lock 74 is thicker than the arms 73 and projects slightly upwardly with respect to the arms 73. Note that the entire length of the lock arm 71 is in such a range as to be accommodated in the width range of the operating portion 61 in forward and backward directions FBD.

As shown in FIG. 7, two plate-like protection walls 77 project on the operating portion 61 at opposite widthwise sides of the lock arm 71 to protect the lock arm 71 from external matter. Two covering portions 78 project in from the inner surfaces of the protection walls 77. The covering portions 78 are connected unitarily to the back plate 72 and cover base end parts of the arms 73 from above or outside. The covering portions 78 prevent an inadvertent unlocking by the finger 50 on the arms 73 and prevent the lock arm 71 from being turned up. Note that the lock 74 and the lock hole 75 are not covered by the covering portions 78.

Figure 3:
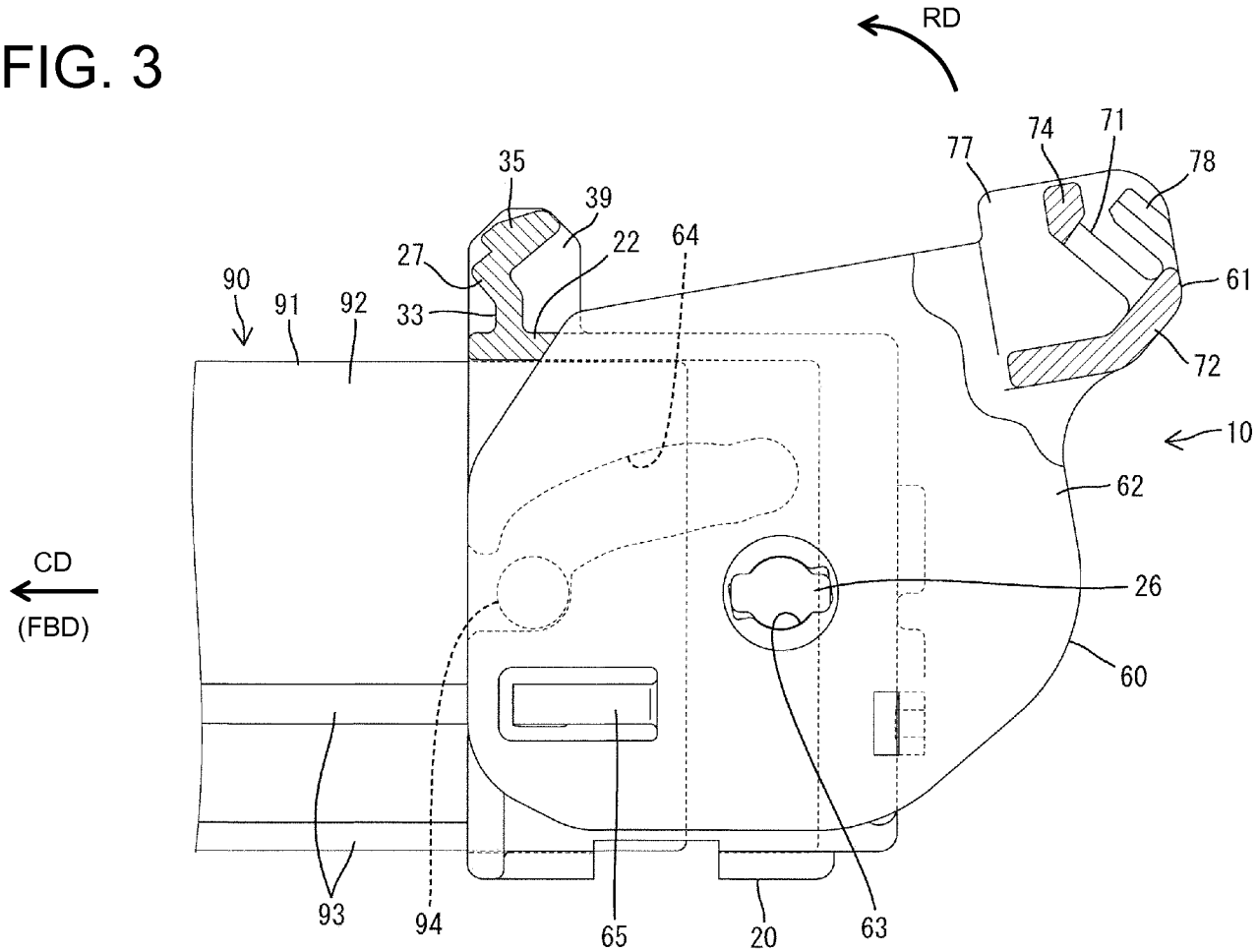
FIG. 3 is a side view showing an essential part in section in an initial state of connecting the housing to the mating connector.

As shown in FIG. 2, the lever 60 initially is held at the initial position IP and the housing 20 is positioned to face the mating connector 90 in this state. At this time, the operating portion 61 of the lever 60 projects back from the rear end of the housing 20. Further, the entrances of the cam grooves 64 of the lever 60 are open forward and face the cam followers 94 of the mating connector 90. In this state, as shown in FIG. 3, the housing 20 is fit lightly to the mating connector 90 so that the cam followers 94 are introduced into the entrances of the cam grooves 64 and the ribs 93 are introduced into the slits 25. The ribs 93 cause the resilient locking pieces 65 to retract from the slits 25. As a result, the operating portion 61 can be gripped to rotate the lever 60 in the rotating direction RD toward the connection position CP.

Figure 4:
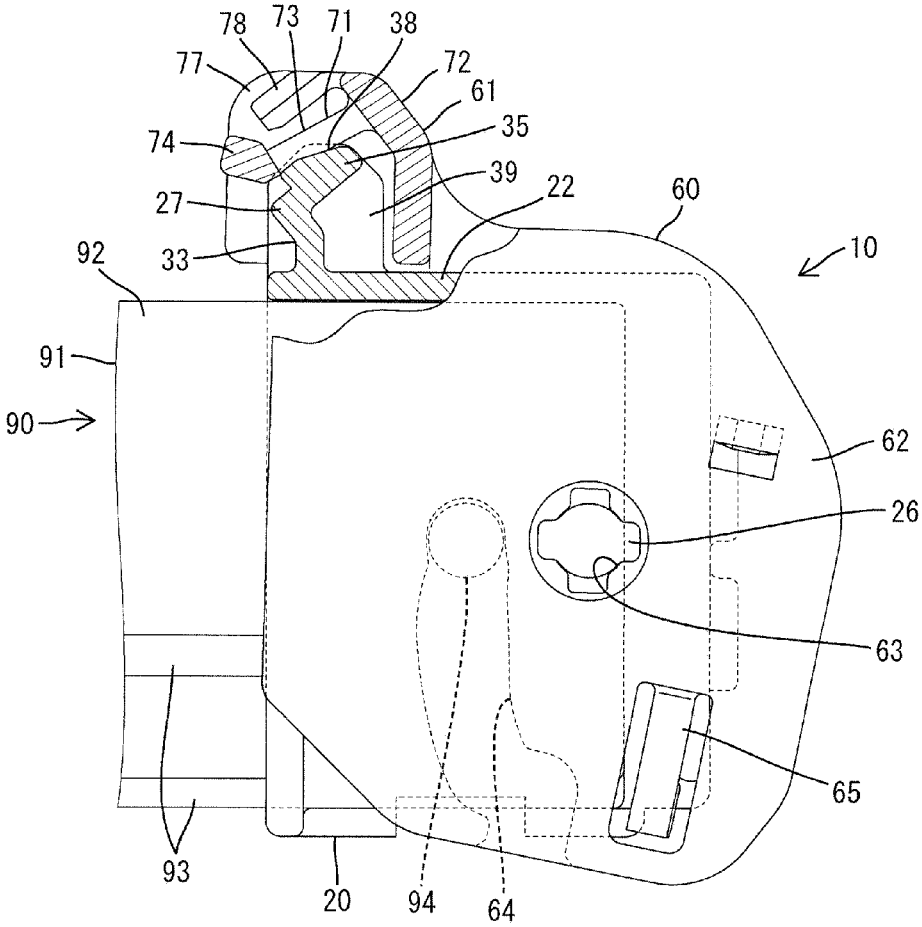
FIG. 4 is a side view of an essential part in section in a state where a lock arm is on an engaging portion at a final stage of connecting the housing to the mating connector.

The lock 74 of the lock arm 71 moves onto the guiding surface 38 of the engaging portion 35 before the lever 60 reaches the connection position CP, as shown in FIG. 4, and the arms 73 deform resiliently up or out. The arms 73 resiliently restore when the lever 60 reaches the connection position CP, as shown in FIG. 1. As a result, the lock 74 is fit into the locking step 36 and the engaging portion 35 is fit into the lock hole 75. In this way, the locking surface 76 of the lock 74 faces the engaging surface 37 of the engaging portion 35 from the front to prevent a returning movement of the lever 60 to the initial position IP. At the connection position CP, the lock 74 is arranged substantially horizontally along the connecting direction CD (forward and backward directions FBD) and the arms 73 are arranged along the oblique direction OD crossing the connecting direction CD and the direction perpendicular to the connecting direction CD. That is, the both arms 73 are substantially parallel to the engaging portion 35. As shown in FIG. 5, the protection walls 77 are at the outer sides of the protecting portions 39.

The lever 60 is held immovably on the housing 20 at the connection position CP and, consequently, the housing 20 is held inseparably on the mating connector 90. Further, at the connection position CP, the respective terminal fittings are connected electrically to the corresponding male tabs at proper depths.

To separate the housing 20 from the mating connector 90, it is necessary to release the locking state of the lock arm 71 and rotate the lever 60 to the initial position IP. The mating connector 90 is coupled to the external member 100 in the case of this embodiment. Thus, an insertion space 80 is formed between the lock arm 71, the base piece 27 and the external member 100 as shown in FIG. 1 to receive the finger 50 for unlocking the lock arm 71. However, this insertion space 80 tends to be narrow and small and it is difficult to place the finger 50 on the lock 74 of the lock arm 71.

Accordingly, the recess 33 is formed in the base end part of the base piece 27, as shown in FIG. 8, so that the finger 50 can be inserted easily into the insertion space 80 by inserting the tip of the finger 50 into the recess 33. The tip of the finger 50 inserted into the recess 33 can be slid out or up along the inner surface of the recess 33 and can be brought into contact with the lock 74 from inside or below. The tip of the finger 50 is pulled out or up away from the fitting tube 22 in this state. Thus, the lock 74 is lifted up to disengage from the engaging portion 35 and the lever 60 is permitted to return to the initial position IP. The cam followers 94 reach the entrances of the cam grooves 64 when the lever 60 is rotated to the initial position IP and the housing 20 can be pulled apart from the mating connector 90.

As described above, the lever 60 of this embodiment is formed with the resiliently deformable lock arm 71 projecting substantially along the rotating direction RD of the lever 60, the housing 20 is formed with the base piece 27 standing in the direction PD1 perpendicular to the connecting direction CD (forward and backward directions FBD) to the mating connector 90, and the engaging portion 35 for resiliently engaging the lock arm 71 is formed on the leading end part of the base piece 27. Thus, the base piece 27 and the lock arm 71 do not project in the connecting direction CD and space efficiency is excellent. Further, the recess 33 is formed in the base end part of the base piece 27 and can receive the finger 50 to release the locking state of the lock arm 71 so that the engaging portion 35 and the lock arm 71 can be disengaged easily. Therefore, operability in releasing the locking state of the lock arm 71 can be improved.

The arms 73 of the lock arm 71 are arranged in the oblique direction OD crossing the connecting direction CD and its perpendicular direction when the housing 20 is connected to the mating connector 90. Thus, the entire length of the lock arm 71 can be made longer with high space efficiency. As a result, an engagement margin of the lock arm 71 with the engaging portion 35 also can be made larger.

Further, the base piece 27 is bent along the recess 33. Hence, the formation range of the recess 33 is not limited to the thickness range of the base end part of the base piece 27 and a degree of freedom in forming the recess 33 can be increased. In addition, a reduction in the rigidity of the base piece 27 can be prevented.

The invention is not limited to the above described embodiment. For example, the following embodiments also are included in the scope of the invention.

The mating connector may be a board connector to be mounted on a printed circuit board or any other mating connector e.g. provided on a wiring harness, an electric device or the like.

The base piece may project in a direction not perpendicular to the connecting direction, but crossing the connecting direction.

The lock arm may be supported on both ends.

The lever may be a single plate.

The lever may include a force multiplying mechanism utilizing a rack and a pinion or a leverage action between the lever and the mating connector.

The housing may be a male connector housing including a receptacle into which male tabs project, and the mating connector may be a female connector that accommodates female terminal fittings.

What is claimed is:

1. A lever-type connector, comprising:

a housing connectable to a mating connector;

a lever mounted rotatably on the housing, the lever being rotatable while engaged with the mating connector for generating a force multiplying action that brings the housing and the mating connector to a properly connected state, the lever being formed with a resiliently deformable lock arm projecting substantially along a rotating direction of the lever; and a base piece projecting from the housing in a projecting direction crossing a connecting direction to the mating connector, the mating connector being coupled to an external member and an insertion space for a finger being formed between the external member and the base piece when the housing is connected to the mating connector, an engaging portion formed on a leading end part of the base piece and resiliently engaging a leading end part of the lock arm for holding the housing and the mating connector in the properly connected state, and a recess formed in a base end part of the base piece and resiliently engaging the leading end part of the lock arm.

2. The lever-type connector of claim 1, wherein the base piece is bent along the recess.

3. A lever-type connector, comprising:

a housing connectable to a mating connector;

a lever mounted rotatably on the housing, the lever being formed with a resiliently deformable lock arm projecting substantially along a rotating direction of the lever, the lock arm being arranged along an oblique direction crossing a connection direction to the mating connector and a direction perpendicular to the connecting direction when the housing is connected to the mating connector; and a base piece projecting from the housing in a projecting direction crossing the connecting direction, an engaging portion formed on a leading end part of the base piece and resiliently engaging a leading end part of the lock arm for holding the housing and the mating connector in the properly connected state, and a recess formed in a base end part of the base piece and resiliently engaging the leading end part of the lock arm.

4. The lever-type connector of claim 3, wherein the lever is rotatable while engaged with the mating connector for generating a force multiplying action that brings the housing and the mating connector to a properly connected state.

5. The lever-type connector of claim 4, wherein the mating connector is coupled to an external member and an insertion space for a finger is formed between the external member and the base piece when the housing is connected to the mating connector.

6. A lever-type connector, comprising:

a housing connectable to a mating connector;

a lever mounted rotatably on the housing, the lever being formed with a resiliently deformable lock arm projecting substantially along a rotating direction of the lever; and a base piece projecting from the housing in a projecting direction crossing a connecting direction to the mating connector, an engaging portion formed on a leading end part of the base piece and resiliently engaging a leading end part of the lock arm for holding the housing and the mating connector in the properly connected state, and a recess formed in a base end part of the base piece and resiliently engaging the leading end part of the lock arm, wherein the base piece includes a bend in an intermediate part projecting in the projecting direction, and a leading end side outside of the bend is at an angle to a base end side.

7. The lever-type connector of claim 6, wherein the base piece includes a first piece at the base side and projecting from the housing in the projecting direction and a second piece at the leading end side and projecting in a direction obliquely out toward the front from the bend.

8. The lever-type connector of claim 7, wherein all of the base piece is behind a front end of the connector housing.

9. The lever-type connector of claim 7, wherein the projecting direction of the second piece and the oblique direction of the engaging portion are substantially perpendicular to each other.

10. The lever-type connector of claim 7, wherein when the lever is at the connection position, a lock of the lever is arranged substantially along the connecting direction and an arm of the lever is arranged along the oblique direction crossing the connecting direction and the direction perpendicular to the connecting direction so that the arm and the engaging portion are substantially parallel.

* * * * *